US011430603B2

(12) United States Patent
Shirai et al.

(10) Patent No.: US 11,430,603 B2
(45) Date of Patent: Aug. 30, 2022

(54) INDUCTOR

(71) Applicant: Murata Manufacturing Co., Ltd., Kyoto-fu (JP)

(72) Inventors: Seigou Shirai, Nagaokakyo (JP); Kachiyasu Satou, Nagaokakyo (JP)

(73) Assignee: Murata Manufacturing Co., Ltd., Kyoto-fu (JP)

( * ) Notice: Subject to any disclaimer, the term of this patent is extended or adjusted under 35 U.S.C. 154(b) by 320 days.

(21) Appl. No.: 16/577,223

(22) Filed: Sep. 20, 2019

(65) Prior Publication Data

US 2020/0098512 A1 Mar. 26, 2020

(30) Foreign Application Priority Data

Sep. 25, 2018 (JP) ..... JP2018-179301

(51) Int. Cl.
*H01F 27/30* (2006.01)
*H01F 27/26* (2006.01)

(52) U.S. Cl.
CPC ..... *H01F 27/30* (2013.01); *H01F 27/263* (2013.01)

(58) Field of Classification Search
CPC .. H01F 27/30; H01F 27/263; H01F 2003/106; H01F 2017/048; H01F 3/10;
(Continued)

(56) References Cited

U.S. PATENT DOCUMENTS 6,417,753 B1 * 7/2002 Wolf ..... H01F 27/346 336/182
2005/0068150 A1 * 3/2005 Matsutani ..... H01F 17/04 336/223
2016/0293316 A1 10/2016 Park et al.

FOREIGN PATENT DOCUMENTS

CN 106057399 A 10/2016
JP 2016-119385 A 6/2016
(Continued)

OTHER PUBLICATIONS

An Office Action; "Notice of Reasons for Refusal", mailed by the Japanese Patent Office dated Feb. 24, 2021, which corresponds to Japanese Patent Application No. 2018-179301 and is related to U.S. Appl. No. 16/577,223; with English language translation.
(Continued)

*Primary Examiner* — Tuyen T Nguyen
(74) *Attorney, Agent, or Firm* — Studebaker & Brackett PC

(57) ABSTRACT

An inductor includes a core including a multilayer part in which magnetic layers and insulating layers are alternately stacked; a coil including a wound part having a winding axis substantially perpendicular to a stacking direction of the multilayer part; and an element body. The multilayer part includes a first multilayer part in which first magnetic layers and insulating layers are alternately stacked and second and third multilayer parts in which second magnetic layers and insulating layers are alternately stacked, the electrical resistivity and/or relative magnetic permeability of the second magnetic layers being larger than those of the first magnetic layers. The first multilayer part has first and second surfaces that are perpendicular to the stacking direction and face each other and third and fourth surfaces that are parallel to the stacking and winding axis directions. The second and third multilayer parts are arranged on the first and second surfaces.

20 Claims, 6 Drawing Sheets

(58) Field of Classification Search
CPC .... H01F 17/04; H01F 27/2847; H01F 27/245; H01F 27/24; H01F 27/2823; H01F 27/2828; H01F 27/34; H01F 2027/348
See application file for complete search history.

(56) References Cited

FOREIGN PATENT DOCUMENTS

| | | | |
|---|---|---|---|
| JP | 2016-195245 | A | 11/2016 |
| WO | 2018/079402 | A1 | 5/2018 |

OTHER PUBLICATIONS

An Office Action mailed by China National Intellectual Property Administration dated Mar. 3, 2021, which corresponds to Chinese Patent Application No. 201910851943.8 and is related to U.S. Appl. No. 16/577,223; with English language translation.

* cited by examiner

INDUCTOR

CROSS-REFERENCE TO RELATED APPLICATION

This application claims benefit of priority to Japanese Patent Application No. 2018-179301, filed Sep. 25, 2018, the entire content of which is incorporated herein by reference.

BACKGROUND

Technical Field

The present disclosure relates to an inductor.

Background Art

An inductor in which a coil is sealed using a sealing material, which is formed by mixing a magnetic powder composed of a soft magnetic alloy and a resin, is widely used as a power inductor used in a choke coil of a DC-DC converter or the like. For example, an inductor disclosed in Japanese Unexamined Patent Application Publication No. 2016-119385 is manufactured by sandwiching and then pressing a coil between pieces of sealing material formed via press molding.

Since this sealing material is formed by mixing a magnetic powder composed of a soft magnetic alloy and a resin, the proportion of the sealing material consisting of the magnetic powder is low and therefore the sealing material has a low relative magnetic permeability. Therefore, the inductance value of an inductor in which a coil is sealed with a sealing material cannot be made as high as an inductor composed of just a soft magnetic alloy. There is a problem in that it is necessary to make the number of turns of the coil high in order to obtain the desired inductance value and consequently the direct current resistance of the inductor is likely to become high. In order to solve this problem, International Publication No. 2018/079402 discloses an inductor in which a core, in which soft magnetic layers and insulating layers are stacked in an alternating manner, is arranged in an inner space of a coil. This inductor can realize a desired inductance value without the number of turns of the coil being made high and can reduce eddy current loss and the like generated by a magnetic field arising from a current that flows through the coil. However, it is necessary to further reduce eddy current loss in order to make DC-DC converters more efficient.

SUMMARY

Accordingly, the present disclosure provides an inductor that has reduced eddy current loss while including a core.

An inductor according to a preferred embodiment of the present disclosure includes a core that includes a multilayer part in which magnetic layers and insulating layers are stacked in an alternating manner; a coil that includes a wound part that is wound around a periphery of the core and a pair of extending parts that extend from the wound part, and in which a winding axis of the wound part is arranged so as to be substantially perpendicular to a stacking direction of the multilayer part; and an element body that has end surfaces that face each other and contains the core and the coil. The magnetic layers include first magnetic layers and second magnetic layers that have a larger electrical resistivity than the first magnetic layers. The multilayer part includes a first multilayer part in which the first magnetic layers and insulating layers are stacked in an alternating manner and a second multilayer part and a third multilayer part in which the second magnetic layers and insulating layers are stacked in an alternating manner. The first multilayer part has a first surface and a second surface that are perpendicular to the stacking direction and face each other and a third surface and a fourth surface that are surfaces that are parallel to the stacking direction and the winding axis direction and face each other. The second multilayer part is arranged on the first surface and the third multilayer part is arranged on the second surface or the second multilayer part is arranged on the third surface and the third multilayer part is arranged on the fourth surface.

An inductor according to a preferred embodiment of the present disclosure includes a core that includes a multilayer part in which magnetic layers and insulating layers are stacked in an alternating manner; a coil that includes a wound part that is wound around a periphery of the core and a pair of extending parts that extend from the wound part, and in which a winding axis of the wound part is arranged so as to be substantially perpendicular to a stacking direction of the multilayer part; and an element body that has end surfaces that face each other and contains the core and the coil. The magnetic layers include first magnetic layers and second magnetic layers that have a larger relative magnetic permeability than the first magnetic layers. The multilayer part includes a first multilayer part in which the first magnetic layers and insulating layers are stacked in an alternating manner and a second multilayer part and a third multilayer part in which the second magnetic layers and insulating layers are stacked in an alternating manner. The first multilayer part has a first surface and a second surface that are perpendicular to the stacking direction and face each other and a third surface and a fourth surface that are surfaces that are parallel to the stacking direction and the winding axis direction and face each other. The second multilayer part is arranged on the first surface and the third multilayer part is arranged on the second surface or the second multilayer part is arranged on the third surface and the third multilayer part is arranged on the fourth surface.

According to the preferred embodiment of the present disclosure, an inductor can be provided that has reduced eddy current loss while including a core.

Other features, elements, characteristics and advantages of the present disclosure will become more apparent from the following detailed description of preferred embodiments of the present disclosure with reference to the attached drawings.

DETAILED DESCRIPTION

Figure 1:
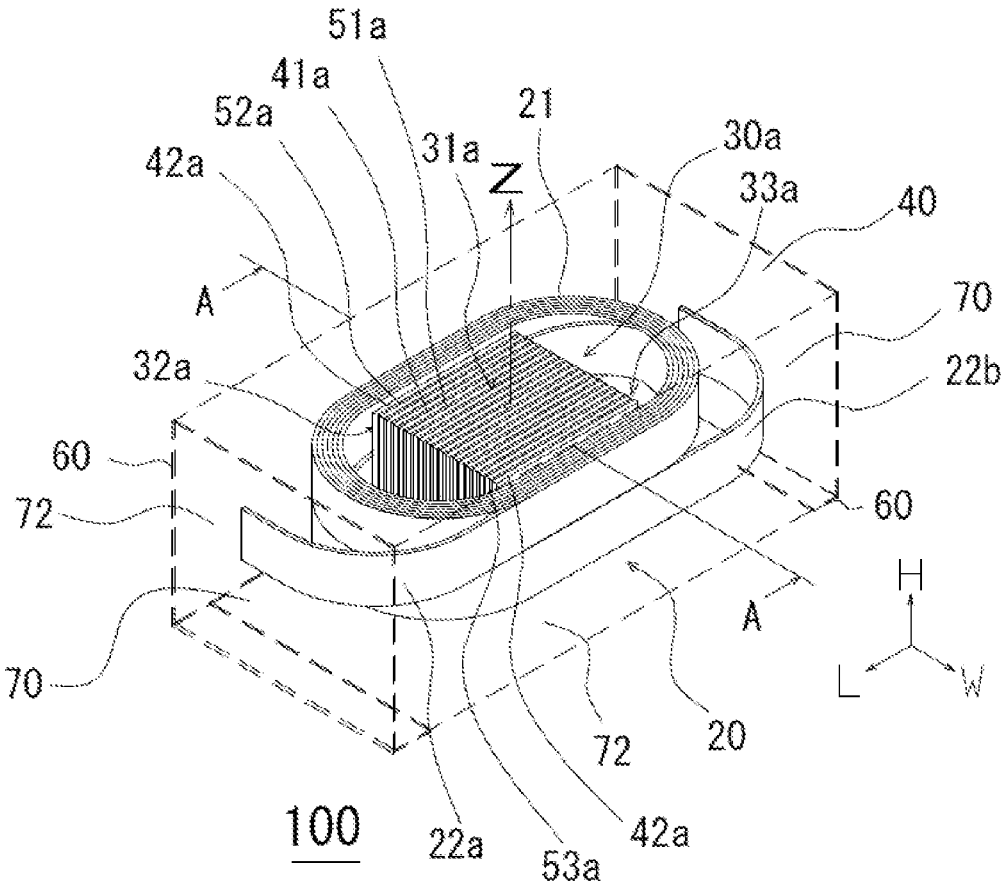
FIG. 1 is a schematic transparent perspective view of an inductor of first embodiment.

An inductor according to this embodiment includes a core including a multilayer part in which magnetic layers and insulating layers are stacked in an alternating manner; a coil that includes a wound part that is wound around the periphery of the core and a pair of extending parts that extend from the wound part; and an element body that has end surfaces that face each other and contains the core and the coil. The coil is arranged so that a winding axis of the wound part is substantially perpendicular to a stacking direction of the multilayer part. In addition, the magnetic layers include first magnetic layers and second magnetic layers that have a larger electrical resistivity than the first magnetic layers. The multilayer part includes a first multilayer part in which the first magnetic layers and insulating layers are stacked in an alternating manner and a second multilayer part and a third multilayer part in which the second magnetic layers and insulating layers are stacked in an alternating manner. The first multilayer part has a first surface and a second surface that are perpendicular to the stacking direction and face each other and a third surface and a fourth surface that are surfaces that are parallel to the stacking direction and the winding axis direction and face each other. The second multilayer part is arranged on the first surface and the third multilayer part is arranged on the second surface or the second multilayer part is arranged on the third surface and the third multilayer part is arranged on the fourth surface.

In the inductor, the core is formed of the multilayer part, which is obtained by stacking magnetic layers and insulating layers, and the core is arranged in an inner space of the wound part with the stacking direction of the multilayer part, i.e., the thickness direction of the magnetic layers, substantially perpendicular to the winding axis of the wound part of the coil. In the multilayer part, the second multilayer part and the third multilayer part, which are formed of the second magnetic layers which have a larger electrical resistivity than the first magnetic layers, are arranged on the outer surfaces of the first multilayer part, which is formed of the first magnetic layers which have a smaller electrical resistivity than the second magnetic layers, and are adjacent to the wire of the wound part. Because of the larger electrical resistivity of the second magnetic layers in the second multilayer part and the third multilayer part, eddy currents generated in cross sections of the magnetic layers in a direction perpendicular to a magnetic path are small and eddy current loss can be reduced compared with the case where the first magnetic layers, which have a small electrical resistivity, are arranged adjacent to the wound part of the coil. Thus, in particular, when a DC-DC converter, in which the inductor is used as a choke coil, has a light load, eddy current loss is reduced in the second multilayer part and the third multilayer part through which magnetic flux passes.

An inductor includes a core including a multilayer part in which magnetic layers and insulating layers are stacked in an alternating manner; a coil that includes a wound part that is wound around the periphery of the core and a pair of extending parts that extend from the wound part; and an element body that has end surfaces that face each other and that contains the core and the coil. The coil is arranged so that a winding axis of the wound part is substantially perpendicular to a stacking direction of the multilayer part. In addition, the magnetic layers include first magnetic layers and second magnetic layers that have a larger relative magnetic permeability than the first magnetic layers. The multilayer part includes a first multilayer part in which the first magnetic layers and insulating layers are stacked in an alternating manner and a second multilayer part and a third multilayer part in which the second magnetic layers and insulating layers are stacked in an alternating manner. The first multilayer part has a first surface and a second surface that are perpendicular to the stacking direction and face each other and a third surface and a fourth surface that are surfaces that are parallel to the stacking direction and the winding axis direction and face each other. The second multilayer part is arranged on the first surface and the third multilayer part is arranged on the second surface or the second multilayer part is arranged on the third surface and the third multilayer part is arranged on the fourth surface. Because of the larger relative magnetic permeability of the second magnetic layers in the second multilayer part and the third multilayer part, eddy currents generated in cross sections of the magnetic layers in a direction perpendicular to a magnetic path are small and eddy current loss can be reduced compared with the case where the first magnetic layers, which have a small relative magnetic permeability, are arranged adjacent to the wound part of the coil.

In the multilayer part of the inductor, the product of the electrical resistivity and the relative magnetic permeability of the second magnetic layers may be larger than the product of the electrical resistivity and the relative magnetic permeability of the first magnetic layers. With this configuration, eddy current loss generated in the inductor at the time of a light load when a DC superimposed current flowing through the inductor is small can be reduced.

In the inductor, a pair of extending parts extend from the outer periphery of the wound part toward opposite end surfaces of the element body, and, in a cross section parallel to the end surfaces, the number of coil turns of the wound part on the side where the extending parts extend is one turn greater than the number of coil turns of the wound part on the side opposite the side where the extending parts extend, and therefore the number of second magnetic layers stacked in the second multilayer part and the number of second magnetic layers stacked in the third multilayer part may be different from each other. In the case where the pair of extending parts extend from the outer periphery of the wound part in opposite directions toward the opposite end surfaces of the element body, eddy current loss at the time of a light load can be more effectively reduced by making the number of stacked second magnetic layers larger in the second multilayer part or the third multilayer part arranged on the side where the extending parts are disposed.

The stacking directions of at least two out of the first multilayer part, the second multilayer part, and the third multilayer part may be different from each other. For example, by arranging the stacking direction of the second multilayer part and the third multilayer part and the stacking direction of the first multilayer part so as to be substantially perpendicular to each other, eddy current loss at the time of a light load can be more effectively reduced.

At least one multilayer part out of the first multilayer part, the second multilayer part, and the third multilayer part may be divided along at least one plane that is substantially perpendicular to the winding axis direction of the wound part. For example, eddy current loss at the time of a light load can be more effectively reduced by dividing at least one multilayer part out of the second multilayer part and the third multilayer part along at least one plane that is substantially perpendicular to the winding axis direction of the wound part.

The thickness of the first magnetic layers and the thickness of the second magnetic layers may be different from each other. In this case, a numerical value obtained by dividing the square of the thickness of the second magnetic layer of the core by the square root of the product of the relative magnetic permeability and electrical resistivity of the second magnetic layer may be smaller than a numerical value obtained by dividing the square of the thickness of the first magnetic layer of the core by the square root of the product of the relative magnetic permeability and electrical resistivity of the first magnetic layer. Eddy current loss is proportional to the square of the thickness of a magnetic layer and inversely proportional to the square root of the product of the relative magnetic permeability and electrical resistivity of a magnetic layer, and therefore eddy current loss at the time of a light load can be more effectively reduced by satisfying the above-described relationship.

Hereafter, embodiments of the present disclosure will be described on the basis of the drawings. The following embodiments are exemplary examples of an inductor for making the technical concepts of the present disclosure clear, and the present disclosure is not limited to the inductors described below. Members described in the scope of the claims are in no way limited to the members described in the embodiments. In particular, unless specifically stated otherwise, it is not intended that scope of the present disclosure be limited to the dimensions, materials, shapes, relative arrangements, and so forth of constituent components described in the embodiments and these are merely explanatory examples. In addition, the sizes of the members illustrated in the drawings, the positional relationships therebetween, and so forth may be exaggerated for the sake of clear explanation. In the following description, identical names and reference symbols are used to denote identical or equivalent members and detailed description of such members is omitted as appropriate. Furthermore, the elements of the present disclosure may also be implemented such that a plurality of elements are formed by the same member and a plurality of elements are shared by a single member, and conversely the function of one member may be shared by a plurality of members. In addition, content described in some embodiment can be utilized in other embodiment. In second embodiment and embodiment thereafter, description of matters common to first embodiment is omitted and the description focuses on the points that are different. In particular, the same operational effects resulting from the same configurations will not be repeatedly described in the individual embodiments.

EMBODIMENTS

First Embodiment

Figure 2:
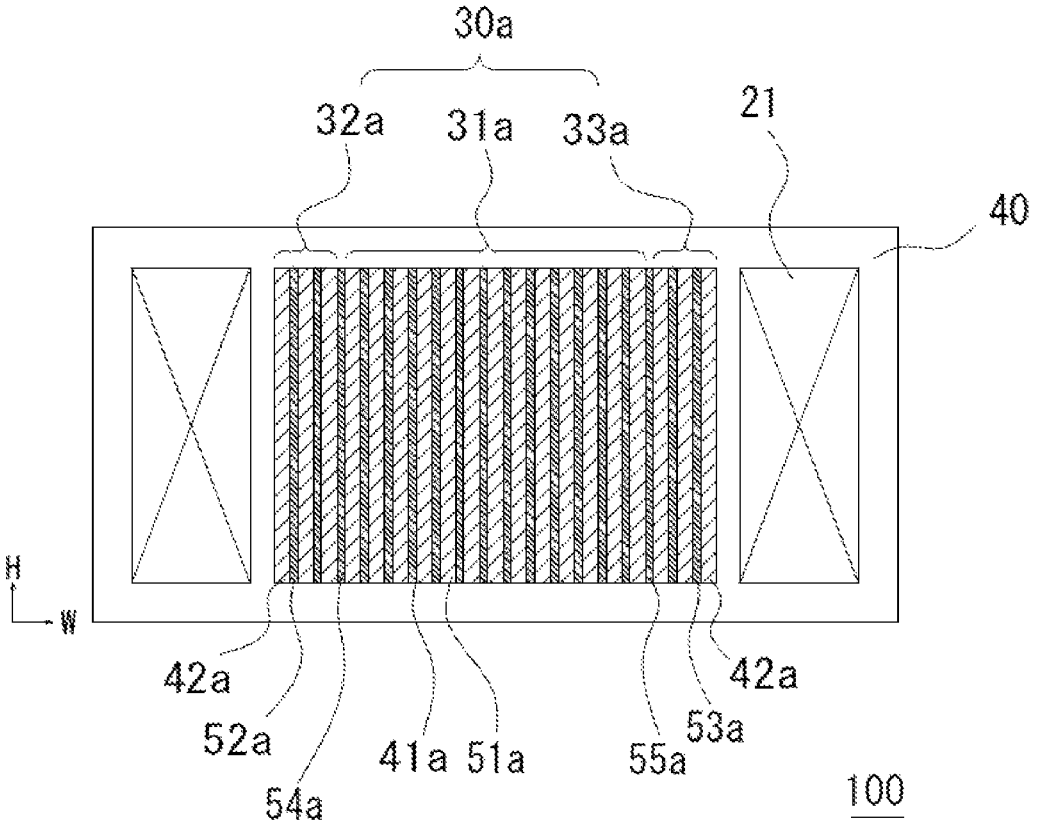
FIG. 2 is a schematic sectional view of the inductor in FIG. 1.

An inductor 100 of first embodiment will be described while referring to FIGS. 1 and 2. FIG. 1 is a schematic transparent perspective view illustrating first embodiment of the inductor 100. FIG. 2 is a schematic sectional view of the inductor 100 along a plane that is parallel to a winding axis of the coil and taken along line A-A in FIG. 1.

As illustrated in FIG. 1, the inductor 100 includes a coil 20 consisting of a wound part 21 and a pair of extending parts 22*a* and 22*b* that extend from the wound part 21; a core 30*a* that is surrounded by the wound part 21 of the coil 20; an element body 40 that contains the coil 20 and the core 30*a*; and a pair of outer terminals 60 that are respectively electrically connected to the extending parts 22*a* and 22*b*. The outer peripheral shape of the wound part 21 as seen in a winding axis direction Z is a substantially elliptical or oval shape having a long axis and a short axis. The element body 40 has a bottom surface that is on a mounting surface side of the element body 40, a top surface that faces the bottom surface, and a pair of end surfaces and a pair of side surfaces that are adjacent to the bottom surface and the top surface and respectively face each other. The pair of end surfaces are substantially perpendicular to the long-axis direction of the wound part 21 and the pair of side surfaces are substantially perpendicular to the short-axis direction of the wound part 21. Furthermore, the element body 40 has a longitudinal direction L that is parallel to the long-axis direction in a cross section perpendicular to the winding axis of the wound part 21, a lateral direction W that is parallel to the short-axis direction, which is perpendicular to the long-axis direction of the wound part 21, and an height direction H of the element body that is parallel to the winding axis direction Z.

The element body 40 is formed by applying pressure to a composite material in which the coil 20 and the core 30*a* are buried. The composite material forming the element body 40 includes a magnetic powder and a binding agent such as a resin, for example. For example, iron (Fe), an iron-based metal magnetic powder such as Fe—Si, Fe—Si—Cr, Fe—Si—Al, Fe—Ni—Al, and Fe—Cr—Al based metal magnetic powders, a metal magnetic powder having a composition that does not contain iron, a metal magnetic powder having another composition that contains iron, an amorphous metal magnetic powder, a metal magnetic powder in which the surfaces of the powder particles are coated with an insulator such as glass, a metal magnetic powder in which the surfaces of the powder particles have been modified, a nano-crystalline metal magnetic powder, a polycrystalline metal magnetic powder, ferrite powder, and so forth can be used as the magnetic powder. Furthermore, a thermally curable resin such as epoxy resin, polyimide resin, and phenol resin, or a thermoplastic resin such as polyester resin and polyamide resin, and so forth is used as the binding agent.

The coil 20 is formed by winding a substantially rectangular cross-section wire having an insulating coating (hereafter, referred to as a flat wire) in two stages such that the wound part 21 is wound in a spiral shape with the extending parts 22*a* and 22*b* located at the outer periphery. The coil 20 has a space that contains the core 30*a* on the inner side of the wound part 21 in which the wire is wound and the coil 20 is arranged inside the element body 40 with a winding axis Z thereof substantially perpendicular to the bottom surface and the top surface of the element body 40. The pair of extending parts 22*a* and 22*b* extend from the outermost periphery of the wound part 21 in opposite directions toward the end surfaces of the element body 40 in the longitudinal direction L and parts of the end portions of the extending parts 22*a* and 22*b* are exposed from the respective end surfaces of the element body 40. The outer terminals 60, which are electrically connected to the end portions of the extending parts 22*a* and 22*b* that are exposed from the element body 40, are provided on the end surfaces and parts of the bottom surface of the element body 40.

A core 30*a* includes a first multilayer part 31*a* in which first magnetic layers 41*a* and insulating layers 51*a* are stacked in an alternating manner; a second multilayer part 32*a* in which second magnetic layers 42*a* and insulating layers 52*a* are stacked in an alternating manner, the second magnetic layers 42*a* having the same thickness and relative magnetic permeability as the first magnetic layers and having a larger electrical resistivity than the first magnetic layers; and a third multilayer part 33*a* in which the second magnetic layers 42*a* and insulating layers 53*a* are stacked in an alternating manner. The first multilayer part 31*a*, the second multilayer part 32*a*, and the third multilayer part 33*a* (in addition, also simply referred to as multilayer parts) each have a substantially rectangular parallelepiped shape. In addition, the first multilayer part 31*a* has a first surface and a second surface that are perpendicular to the stacking direction, are positioned at the outermost layers, and face each other, a third surface and a fourth surface that are surfaces that are adjacent to the first surface and the second surface and parallel to the stacking direction and the winding axis direction, and that face each other, and a further two side surfaces. In an inductor 100, the second multilayer part 32*a*, the first multilayer part 31*a*, and the third multilayer part 33*a* are stacked in this order with the stacking directions thereof aligned so as to form the core 30*a*. In other words, the second multilayer part 32*a* and the third multilayer part 33*a* are respectively arranged on the first surface and the second surface, which face each other, of the first multilayer part 31*a* with the stacking directions thereof parallel to each other. The core 30*a* is housed in an inner space of a wound part 21 with the stacking direction thereof substantially perpendicular to the winding axis of the wound part 21. In the core 30*a*, the second multilayer part 32*a* and the third multilayer part 33*a*, which are formed of the second magnetic layers having a large electrical resistivity, are arranged so as to be closer to the wire forming the wound part 21 than the first multilayer part.

As illustrated in FIG. 2, the core 30*a* and the wound part 21 of the coil are arranged so as to be contained inside an element body 40 and the wire forming the wound part 21 of the coil is arranged so as to be adjacent to the outer sides of the second multilayer part 32*a* and the third multilayer part 33*a* of the core 30*a*. In FIG. 2, the height of the core 30*a* and the height of the wound part 21 are formed so as to be substantially identical. The core 30*a* includes the first multilayer part 31*a* in which the first magnetic layers 41*a* and the insulating layers 51*a* are stacked; the second multilayer part 32*a* in which the second magnetic layers 42*a* and the insulating layers 52*a* are stacked, the second magnetic layers 42*a* having a larger electrical resistivity than the first magnetic layers 41*a*; and the third multilayer part 33*a* in which the second magnetic layers 42*a* and the insulating layers 53*a* are stacked. The stacking directions of the first multilayer part 31*a*, the second multilayer part 32*a*, and the third multilayer part 33*a* are identical. The outermost layers of the second multilayer part 32*a* and the third multilayer part 33*a* are formed of the second magnetic layers 42*a*. In addition, the second multilayer part 32*a* and the third multilayer part 33*a* are respectively arranged on the surfaces of the outermost layers of the first multilayer part 31*a* on both sides in the stacking direction of the first multilayer part 31*a* and are arranged so as to be closer to the wire of the wound part 21 than the first multilayer part 31*a*. Insulating layers 54*a* and 55*a* are respectively arranged between the first multilayer part 31*a* and the second multilayer part 32*a* and between the first multilayer part 31*a* and the third multilayer part 33*a*.

The first magnetic layers 41*a* and the second magnetic layers 42*a* are, for example, formed so as to have substantially identical thicknesses, have thin plate-like shapes, and so as to at least have different electrical resistivities from each other. The first magnetic layers 41*a* and the second magnetic layers 42*a* may have substantially identical relative magnetic permeabilities, for example. The first magnetic layers 41*a* and the second magnetic layers 42*a* are, for example, composed of a soft magnetic material selected from a group consisting of iron, silicon steel, permalloy, sendust, permendur, soft ferrite, an amorphous magnetic alloy, a nanocrystalline magnetic alloy, and alloys of any of these materials. In addition, the first magnetic layers 41*a* and the second magnetic layers 42*a* may be formed using another material provided that the material has a higher relative magnetic permeability than the composite material forming the element body 40. In addition to electrically insulating the first magnetic layers 41*a* and the second magnetic layers 42*a* from each other and adhering the first magnetic layers 41*a* and the second magnetic layers 42*a* to each other, the insulating layers electrically insulate the multilayer parts from each other and adhere the multilayer parts to each other. In FIG. 2, the insulating layers have substantially identical thicknesses. The insulating layers are formed of a material including at least one selected from a group consisting of epoxy resin, polyimide resin, and polyamide-amide resin, for example.

The second magnetic layers 42*a* have a larger electrical resistivity than the first magnetic layers 41*a*. The ratio of electrical resistivity of the second magnetic layers 42*a* with respect to the electrical resistivity of the first magnetic layers 41*a* is for example larger than 1 and preferably greater than or equal to 1.3.

A thickness ratio (b/a) of a thickness b of the insulating layers with respect to a thickness a of the magnetic layers in the first multilayer part 31*a*, the second multilayer part 32*a*, and the third multilayer part 33*a* is for example less than or equal to 0.2, and the thickness b of the insulating layers is on the order of several μm. Here, an example of a method of obtaining the thickness ratio will be described. The thickness ratio (b/a) is obtained by dividing the thickness b of the insulating layers 51*a* by the thickness a of the magnetic layers that form the multilayer part. The thickness a and the thickness b are obtained by measuring the thicknesses of all the magnetic layers 41*a* and 42*a* and the thicknesses of all the insulating layers 51*a* along a normal line at substantially the center of the core in the stacking direction in a cross-sectional observational image of substantially the center of the core and taking the average values of the measured values as the thicknesses a and b.

In general, loss in an inductor can be divided into copper loss caused by the wire forming the coil and iron loss, which is the sum of eddy current loss and hysteresis loss caused by the core. In addition, at the time of a light load, a DC superimposed current is small and magnetic flux is concentrated at positions close to the wire forming the wound part. At the time of a heavy load, the DC superimposed current is large and the magnetic flux is spread out to positions that are far from the wire.

In the inductor 100, since the core 30*a* is arranged inside the inner space of the wound part 21, at the time of a light load, the magnetic flux density, which causes eddy currents, is high in the second multilayer part 32*a* and the third multilayer part 33*a*, which are on the side close to the wire of the wound part 21 of the core 30*a*, but since the electrical resistivity of the second magnetic layers 42*a* is larger than that of the first magnetic layers 41*a*, eddy current loss is reduced and iron loss is small. On the other hand, at the time of a heavy load, the magnetic flux density is high in the second multilayer part 32*a*, the third multilayer part 33*a*, and the first multilayer part 31*a*, but since the copper loss is larger due to an increase in the DC superimposed current, the effect of the iron loss is relatively small. Therefore, the thus-configured inductor 100 has eddy current loss that is particularly reduced at the time of a light load while including a core.

Table 1 illustrates the results of a simulation of the inductance value and eddy current loss Pe of an inductor of first embodiment using a core obtained by stacking a second multilayer part composed of magnetic layers b and insulating layers, a first multilayer part composed of magnetic layers a and insulating layers, and a third multilayer part composed of the magnetic layers b and insulating layers in this order, where the DC superimposed current was 0 A, the amplitude of the AC current was 10 mA, an electrical resistivity $\rho_a$ of the magnetic layers a was fixed, and an electrical resistivity $\rho_b$ of the magnetic layers b was varied. In the inductor of first embodiment, the relative magnetic permeabilities of the magnetic layers a and the magnetic layers b were identical, the magnetic layers a and b had saturation magnetic flux densities Bs of 1.0 T, the element body dimensions L×W×H were 2.0 mm×1.6 mm×1.0 mm, and the number of turns of the winding was 8.5. Furthermore, the DC superimposed saturation current was assumed to be the DC superimposed current when inductance value is reduced by 30% with respect to the inductance value when the DC superimposed current is 0. The simulation was carried out by performing harmonic magnetic field analysis at a frequency of 10 MHz using the finite element analysis software Femtet (Registered Trademark) produced by Murata Software Co., Ltd.

TABLE 1

| | MAGNETIC LAYERS | | MAGNETIC LAYER CHARACTERISTICS | | | | |
|---|---|---|---|---|---|---|---|
| | MAGNETIC LAYERS a THICKNESS | MAGNETIC LAYERS b THICKNESS | | ELECTRICAL RESISTIVITY | | EDDY CURRENT | |
| No. | (μm) × NUMBER OF LAYERS | (μm) × NUMBER OF LAYERS | RELATIVE MAGNETIC PERMEABILITYμ | MAGNETIC LAYERS a $\rho_a$ (μΩ · m) | MAGNETIC LAYERS b $\rho_b$ (μΩ · m) | LOSS Pe (μW, 10 MHz) | INDUCTANCE VALUE (μH) |
| EMBODIMENT 1 | 14 × 24 | 14 × 3 | 5,000 | 0.8 | 0.8 | 110.9 | 1.012 |
| | | | | | 1.0 | 99.5 | |
| | | | | | 1.2 | 90.7 | |

The inductors of first embodiment have the same inductance value, and therefore the inductors can be regarded as being identical inductors with respect to characteristics other than eddy current loss. It is clear from the results obtained for first embodiment that eddy current loss decreases as the more the electrical resistivity $\rho_b$ of the magnetic layers b is increased from the electrical resistivity $\rho_a$ of the magnetic layers a. That is, eddy current loss can be reduced while maintaining the inductance value of the inductor by arranging magnetic layers having a high electrical resistivity adjacent to the wound part.

Second Embodiment

An inductor of second embodiment has substantially the same configuration as the inductor 100 of first embodiment except that the relative magnetic permeability of the second magnetic layers is larger than the relative magnetic permeability of the first magnetic layers. In the inductor of second embodiment, the electrical resistivity of the second magnetic layers may be substantially identical to the electrical resistivity of the first magnetic layers.

Table 2 illustrates the results of a simulation of the inductance value and eddy current loss Pe of inductors in which the configuration of a multilayer part forming a core was varied, the multilayer part being formed by stacking a second multilayer part composed of magnetic layers b and insulating layers, a first multilayer part composed of magnetic layers a and insulating layers, and a third multilayer part composed of the magnetic layers b and insulating layers in this order, where the DC superimposed current was 0 A, the amplitude of the AC current was 10 mA, and the thicknesses, numbers, relative magnetic permeabilities, and electrical resistivities of the magnetic layers a and magnetic layers b were varied. In the inductors of embodiment 2a to 2c, the thicknesses of the magnetic layers a and the magnetic layers b were identical, the relative magnetic permeability $\mu_b$ of the magnetic layers b was larger than the relative magnetic permeability $\mu_a$ of the magnetic layers a, and the electrical resistivities ρ of the magnetic layers a and the magnetic layers b were varied in the same manner. In the inductors of embodiment 2d to 2f, the thicknesses and relative magnetic permeabilities μ of the magnetic layers a and the magnetic layers b were identical and the electrical resistivities ρ of the magnetic layers a and the magnetic layers b were varied in the same manner.

TABLE 2

| No. | MAGNETIC LAYERS: MAGNETIC LAYERS a THICKNESS (μm) × NUMBER OF LAYERS | MAGNETIC LAYERS: MAGNETIC LAYERS b THICKNESS (μm) × NUMBER OF LAYERS | MAGNETIC LAYER CHARACTERISTICS: RELATIVE MAGNETIC PERMEABILITY μ: MAGNETIC LAYERS a $\mu_a$ | MAGNETIC LAYER CHARACTERISTICS: RELATIVE MAGNETIC PERMEABILITY μ: MAGNETIC LAYERS b $\mu_b$ | MAGNETIC LAYER CHARACTERISTICS: ELECTRICAL RESISTIVITY ρ (μΩ · m) | EDDY CURRENT LOSS Pe (μW, 10 MHz) | INDUCTANCE VALUE (μH) |
|---|---|---|---|---|---|---|---|
| EMBODIMENT 2a | 14 × 24 | 14 × 3 | 5,000 | 50,000 | 0.8 | 59.4 | 1.017 |
| | | | | | 1.0 | 55.8 | |
| | | | | | 1.2 | 53.2 | |
| EMBODIMENT 2b | 25 × 14 | 25 × 2 | 5,000 | 50,000 | 0.8 | 73.7 | 1.017 |
| | | | | | 1.0 | 68.7 | |
| | | | | | 1.2 | 64.9 | |
| EMBODIMENT 2c | 25 × 14 | 14 × 3 | 5,000 | 50,000 | 0.8 | 62.2 | 1.013 |
| | | | | | 1.0 | 58.3 | |
| | | | | | 1.2 | 55.5 | |
| EMBODIMENT 2d | 14 × 24 | 14 × 3 | 5,000 | 5,000 | 0.8 | 110.9 | 1.012 |
| | | | | | 1.0 | 93.3 | |
| | | | | | 1.2 | 80.6 | |
| EMBODIMENT 2e | 25 × 14 | 25 × 2 | 5,000 | 5,000 | 0.8 | 109.9 | 1.013 |
| | | | | | 1.0 | 98.0 | |
| | | | | | 1.2 | 89.5 | |
| EMBODIMENT 2f | 25 × 14 | 14 × 3 | 5,000 | 5,000 | 0.8 | 116.9 | 1.007 |
| | | | | | 1.0 | 100.7 | |
| | | | | | 1.2 | 88.4 | |

Since there are no large differences between the inductance values of the inductors of embodiment 2a to 2f, the inductors can be regarded as being identical inductors with respect to characteristics other than eddy current loss. If we compare embodiment 2a and embodiment 2d, embodiment 2b and embodiment 2e, and embodiment 2c and embodiment 2f, it is clear that eddy current loss is reduced by making the relative magnetic permeability of the magnetic layers b larger than the relative magnetic permeability of the magnetic layers a. In other words, in particular, eddy current loss at the time of a light load is reduced as a result of arranging the second multilayer part and the third multilayer part, which are formed by stacking the second magnetic layers which have a large relative magnetic permeability, adjacent to the wound part.

Next, the eddy current loss of an inductor will be explained.

In general, in an inductor, when p is the electrical resistivity of magnetic layers and μ is the relative magnetic permeability of magnetic layers, eddy current loss Pe in magnetic layers of a core formed by stacking magnetic layers and insulating layers on top of one another is proportional to the square of a thickness t of the magnetic layers and inversely proportional to the square root of the product of the electrical resistivity p and the relative magnetic permeability pt of the magnetic layers in the case where the thickness t of the magnetic layers is sufficiently smaller than the planar direction width of the flat-plate-shaped magnetic layers. In other words, the eddy current loss Pe is given by formula (1) below.

$$Pe \propto \frac{t^2}{\sqrt{\rho \times \mu}} \tag{1}$$

For example, in the inductor 100 of first embodiment, only the electrical resistivity of the magnetic layers of the second multilayer part and the third multilayer part was increased in order make the eddy current loss generated in the second multilayer part and the third multilayer part smaller than the eddy current loss generated in the first multilayer part. However, it is clear from formula (1) that a numerical value obtained by dividing the square of the thickness of the second magnetic layer by the square root of the product of the relative magnetic permeability and electrical resistivity of the second magnetic layer may be made smaller than a numerical value obtained by dividing the square of the thickness of the first magnetic layer by the square root of the product of the relative magnetic permeability and electrical resistivity of the first magnetic layer in order to make the eddy current loss generated in the second multilayer part and the third multilayer part smaller than the eddy current loss generated in the first multilayer part. In other words, eddy current loss can be made even smaller by changing the relative magnetic permeabilities of the respective layers in addition to making the electrical resistivity of the second magnetic layers larger than the electrical resistivity of the first magnetic layers.

Third Embodiment

An inductor of third embodiment has substantially the same configuration as the inductor 100 of first embodiment except that a relationship that the product of the electrical resistivity and the relative magnetic permeability of the second magnetic layers is larger than the product of the electrical resistivity and the relative magnetic permeability of the first magnetic layers is satisfied. The first magnetic layers and the second magnetic layers have identical thicknesses and relative magnetic permeabilities. In the inductor of third embodiment, the first magnetic layers and the second magnetic layers may have different electrical resistivities and relative magnetic permeabilities from each other, the first magnetic layers and the second magnetic layers may have substantially identical electrical resistivities and different relative magnetic permeabilities from each other, or the first magnetic layers and the second magnetic layers may have substantially identical relative magnetic permeabilities and different electrical resistivities from each other.

In the inductor of third embodiment, the second multilayer part and the third multilayer part, which are formed by stacking the second magnetic layers, the product of the electrical resistivity and relative magnetic permeability of the second magnetic layers being larger than that of the first magnetic layers, are arranged adjacent to the conductor of the wound part, and therefore in particular the eddy current loss at the time of a light load is reduced.

Fourth Embodiment

Figure 3:
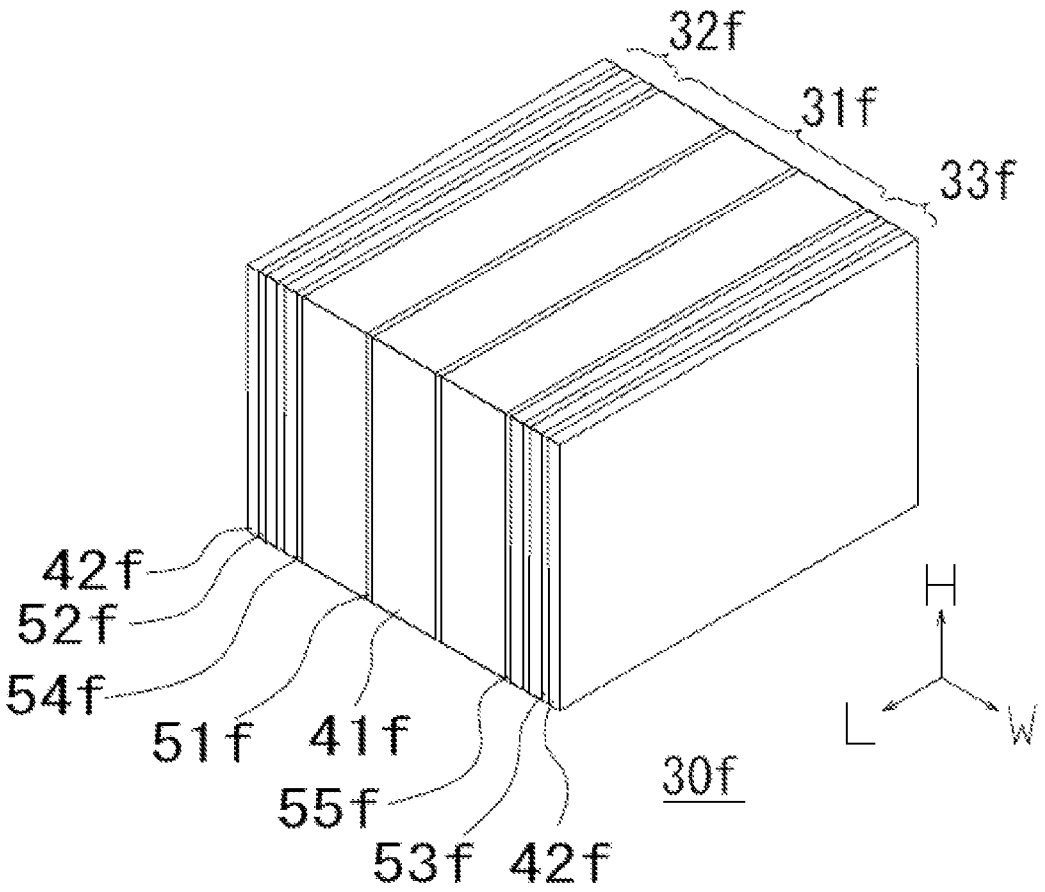
FIG. 3 is a schematic perspective view illustrating an example of a core of an inductor of fourth embodiment.

The configuration of a core 30*f* built into an inductor of fourth embodiment will be described while referring to FIG. 3. The inductor of fourth embodiment has substantially the same configuration as the inductor of second embodiment or the inductor of third embodiment except that, in the core 30*f*, the thickness of first magnetic layers 41*f* forming a first multilayer part 31*f* and the thickness of second magnetic layers 42*f* forming a second multilayer part 32*f* and a third multilayer part 33*f* are different from each other.

In the core 30*f*, the first multilayer part 31*f* is formed by stacking the first magnetic layers 41*f* and insulating layers 51*f* in the lateral W direction of the element body, which is perpendicular to the longitudinal direction L of the element body and the winding axis direction Z of the coil.

The second multilayer part 32*f* is formed by stacking the second magnetic layers 42*f* and insulating layers 52*f* in the lateral direction W of the element body and the third multilayer part 33*f* is formed by stacking the second magnetic layers 42*f* and insulating layers 53*f* in the lateral direction W of the element body. The second multilayer part 32*f* and the third multilayer part 33*f* are respectively arranged on the surfaces of the outermost layers of the first multilayer part 31*f* on both sides in the stacking direction of the first multilayer part 31*f* with insulating layers 54*f* and 55*f* interposed therebetween. In the core 30*f*, the thickness of the second magnetic layers 42*f* is formed so as to be smaller than the thickness of the first magnetic layers 41*f* and a numerical value obtained by dividing the square of the thickness of the second magnetic layer 42*f* by the square root of the product of the relative magnetic permeability and electrical resistivity of the second magnetic layer 42*f* is smaller than a numerical value obtained by dividing the square of the thickness of the first magnetic layer 41*f* by the square root of the product of the relative magnetic permeability and electrical resistivity of the first magnetic layer 41*f*. Thus, eddy current loss at the time of a light load can be more efficiently reduced.

Fifth Embodiment

Figure 4:
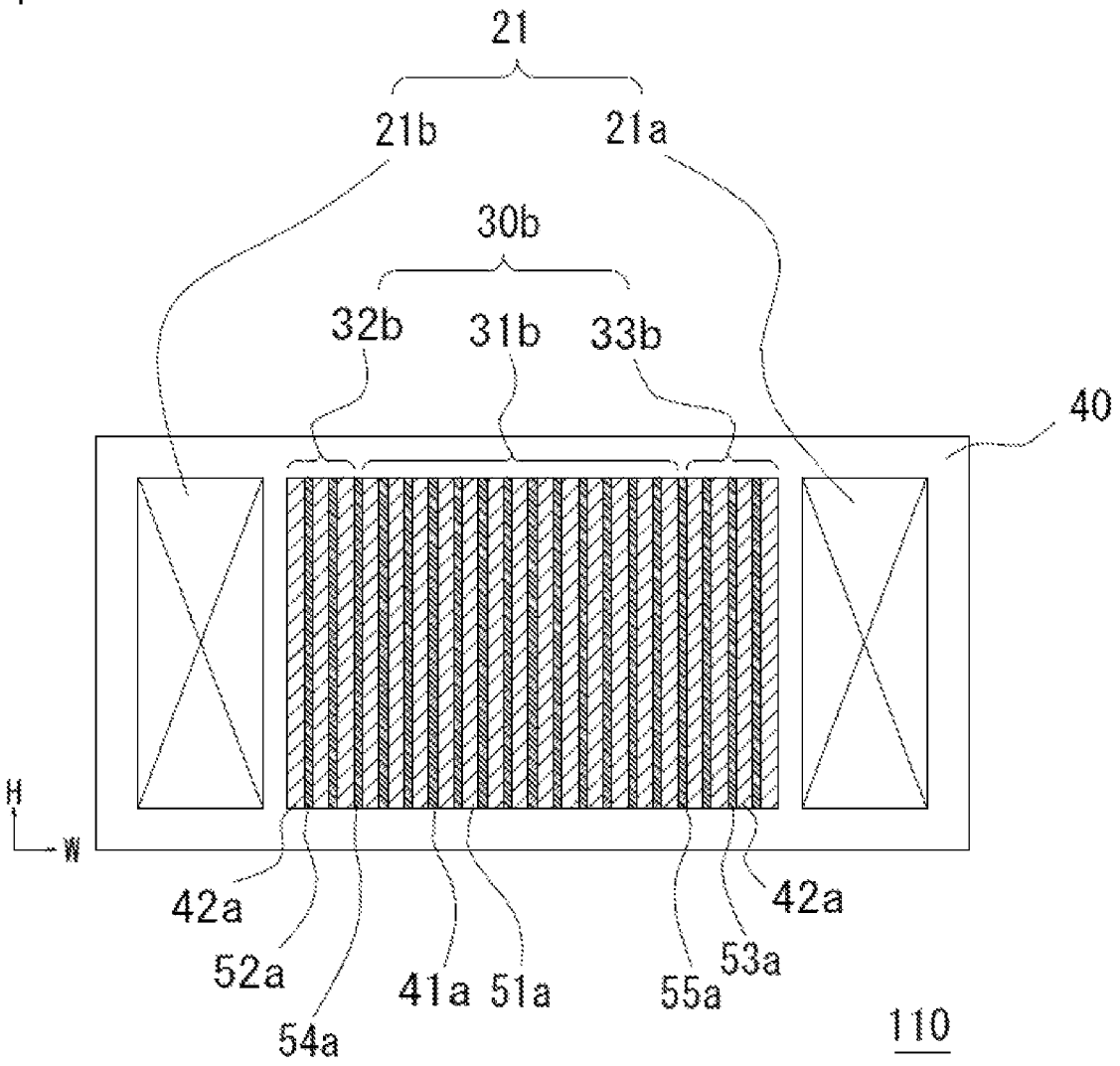
FIG. 4 is a schematic sectional view of an inductor of fifth embodiment.

An inductor 110 of fifth embodiment will be described while referring to FIG. 4. FIG. 4 is a schematic sectional view of the inductor 110 taken at the same position as line A-A in FIG. 1. The inductor 110 has substantially the same configuration as the inductor 100 of first embodiment, the inductor of second embodiment, or the inductor of third embodiment except that, in a core 30*b*, the number of second magnetic layers 42*a* stacked in a third multilayer part 33*b*, which is arranged adjacent to a side 21*a* of the wound part 21 where the end portions of the coil extend, is greater than the number of second magnetic layers 42*a* stacked in a second multilayer part 32*b*.

In the case where a pair of extending parts extend toward opposite end surfaces of the element body, the wound part is not symmetrical in a left-right direction in a cross section parallel to the end surfaces. That is, in the sectional view in FIG. 4, in the case where the extending parts extend from the right side 21*a* of the wound part 21, the wire is wound through one more turn on the right side 21*a* of the wound part 21 than on a left side 21*b* of the wound part 21. Thus, the magnetic flux density is higher on the right side 21*a* of the wound part 21 than on the left side 21*b* of the wound part 21. In the inductor 110, there are different numbers of second magnetic layers 42*a* stacked in the second multilayer part 32*b* and the third multilayer part 33*b*, and there is a greater number of second magnetic layers 42*a* stacked in the third multilayer part 33*b*, which is arranged on the right side 21*a* of the wound part 21. With this configuration, loss generated in the inductor 110 at the time of a light load can be more effectively reduced. An extending part of the coil may extend toward the opposite end surface and be exposed at the opposite end surface or may be bent and then exposed at the bottom surface of the element body.

Sixth Embodiment

Figure 5:
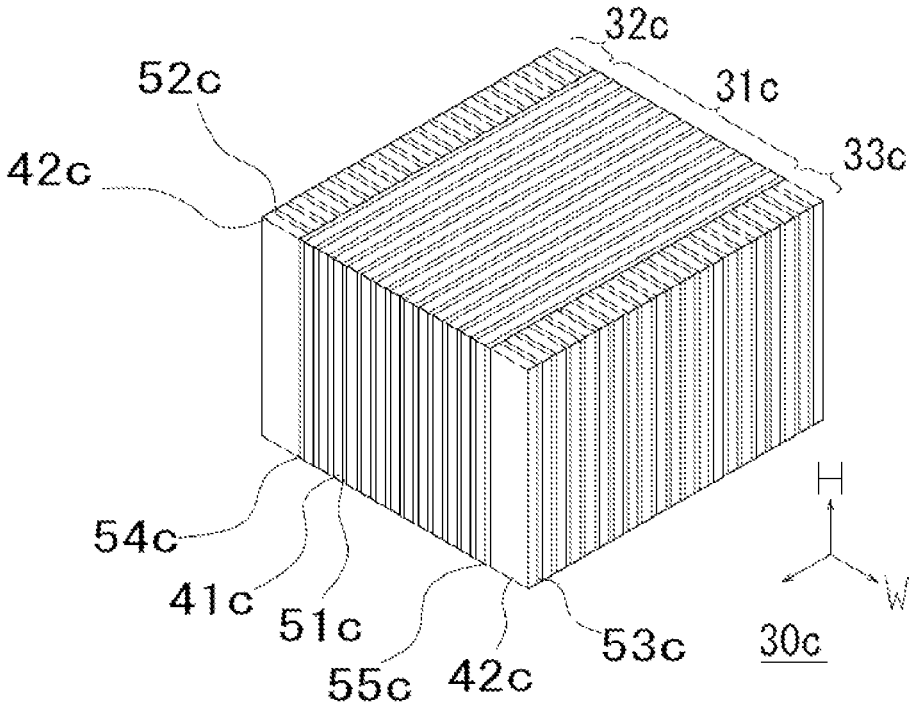
FIG. 5 is a schematic perspective view illustrating an example of a core of an inductor of sixth embodiment.

The configuration of a core 30*c* built into an inductor of sixth embodiment will be described while referring to FIG. 5. The inductor of sixth embodiment differs from the inductor 100 of first embodiment, the inductor of second embodiment, or the inductor or third embodiment in that the stacking direction of a first multilayer part 31*c* and the stacking direction of a second multilayer part 32*c* and a third multilayer part 33*c* of a core 30*c* are substantially perpendicular to each other, but in other respects has substantially the same configuration as the inductor 100 of first embodiment, the inductor of second embodiment, or the inductor of third embodiment.

In the core 30*c*, the first multilayer part 31*c* is formed by stacking first magnetic layers 41*c* and insulating layers 51*c* in the lateral direction W of the element body. The second multilayer part 32*c* is formed by stacking second magnetic layers 42*c* and insulating layers 52*c* in the longitudinal direction L of the element body, and the third multilayer part 33*c* is formed by stacking the second magnetic layers 42*c* and insulating layers 53*c* in the longitudinal direction L of the element body. The second multilayer part 32*c* and the third multilayer part 33*c* are arranged on the surfaces of the outermost layers of the first multilayer part 31*c* on both sides in the stacking direction with insulating layers 54*c* and 55*c* interposed therebetween, and cover the outermost surfaces of the first multilayer part 31*c* on both sides in the stacking direction. The numbers of second magnetic layers 42*c* stacked in the second multilayer part 32*c* and the third multilayer part 33*c* are greater than the numbers of second magnetic layers 42*a* stacked in the second multilayer part 32*a* and the third multilayer part 33*a* of the core 30*a* of first embodiment, and the width (W direction) of the magnetic layers in a direction perpendicular to the magnetic path is smaller than in the second multilayer part 32*a* and the third multilayer part 33*a* of the core 30*a* of first embodiment. Eddy current loss is proportional to the width (W direction) of the magnetic layers in a direction perpendicular to the magnetic path, and therefore eddy current loss of the inductor at the time of a light load is further reduced.

Seventh Embodiment

Figure 6:
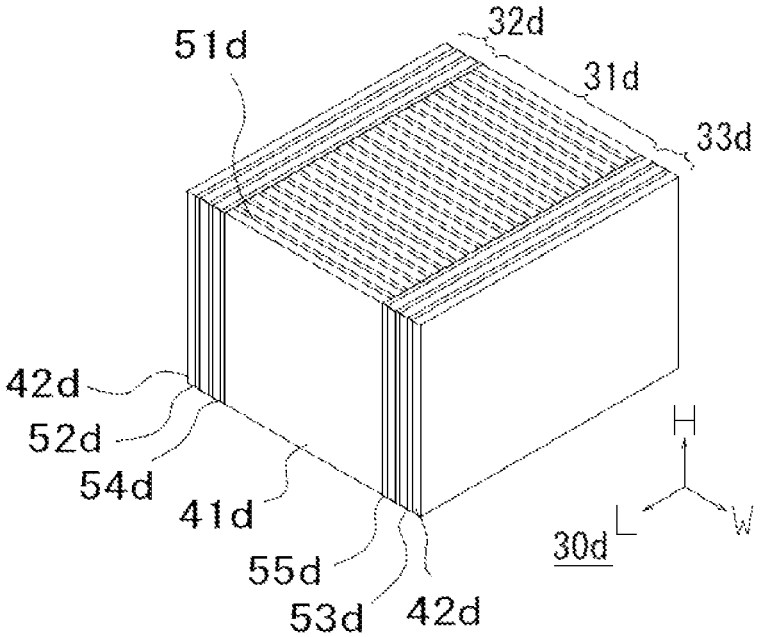
FIG. 6 is a schematic perspective view illustrating an example of a core of an inductor of seventh embodiment.

The configuration of a core 30*d* built into an inductor of seventh embodiment will be described while referring to FIG. 6. The inductor of seventh embodiment has substantially the same configuration as the inductor 100 of first embodiment, the inductor of second embodiment, or the inductor of third embodiment except that the stacking direction of a first multilayer part 31*d* of the core 30*d* is substantially parallel to the longitudinal direction L of the element body and is perpendicular to the stacking direction of the second multilayer part and the third multilayer part.

In the core 30*d*, the first multilayer part 31*d* is formed by stacking first magnetic layers 41*d* and insulating layers 51*d* in the longitudinal direction L of the element body. A second multilayer part 32*d* is formed by stacking second magnetic layers 42*d* and insulating layers 52*d* in the lateral direction W of the element body and a third multilayer part 33*d* is formed by stacking the second magnetic layers 42*d* and insulating layers 53*d* in the lateral direction W of the element body. The second multilayer part 32*d* and the third multilayer part 33*d* are arranged on the third surface and the fourth surface, which are surfaces that are adjacent to the surfaces of the outermost layers of the first multilayer part 31*d* on both sides in the stacking direction and are parallel to the winding axis direction, and are side surfaces that face each other, with insulating layers 54*d* and 55*d* interposed therebetween and cover the facing side surfaces of the first multilayer part 31*d*.

The number of first magnetic layers 41*d* stacked in the first multilayer part 31*d* is greater than the number of first magnetic layers stacked in the first multilayer part 31*a* of the core 30*a* of first embodiment, and the width (W direction) of the magnetic layers in a direction perpendicular to the magnetic path is smaller than in the first multilayer part 31*a* of the core 30*a* of first embodiment. Therefore, eddy current loss generated at the opposite end surfaces in the longitudinal direction L can be reduced and loss in the inductor at the time of a light load is reduced.

Eighth Embodiment

Figure 7:
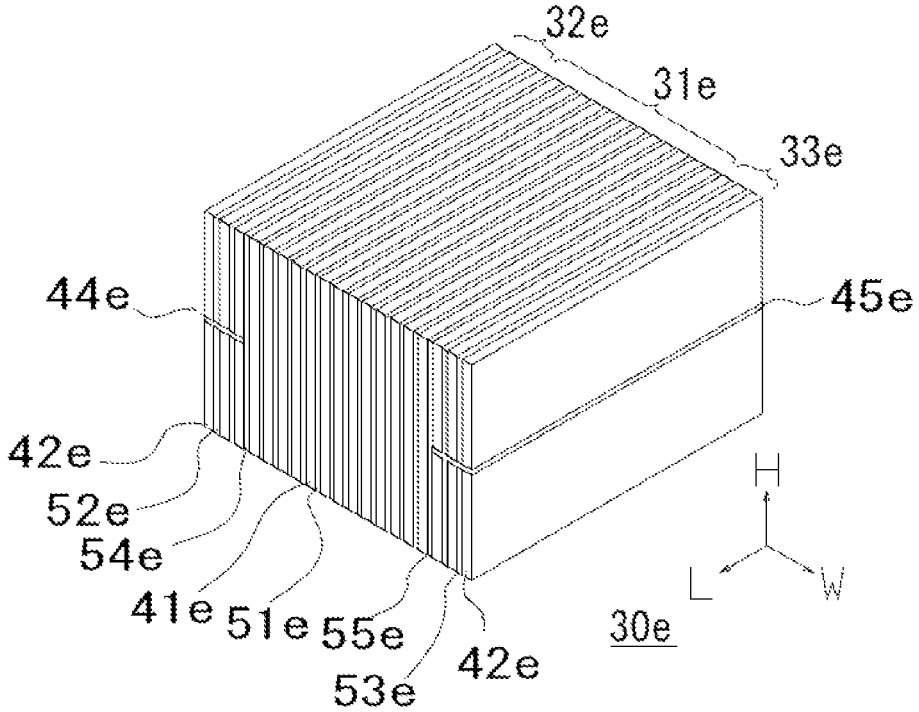
FIG. 7 is a schematic perspective view illustrating an example of a core of an inductor of eighth embodiment.

The configuration of a core 30*e* built into an inductor of eighth embodiment will be described while referring to FIG. 7. The inductor of eighth embodiment has substantially the same configuration as the inductor 100 of first embodiment, the inductor of second embodiment, or the inductor of third embodiment except that a second multilayer part 32*e* and a third multilayer part 33*e* of the core 30*e* are respectively divided by gap parts 44*e* and 45*e* that are substantially perpendicular to the winding axis direction Z.

In the core 30*e*, a first multilayer part 31*e* is formed by stacking first magnetic layers 41*e* and insulating layers 51*e* in the lateral direction W of the element body. The second multilayer part 32*e* is formed by stacking second magnetic layers 42*e* and insulating layers 52*e* in the lateral direction W of the element body and the third multilayer part 33*e* is formed by stacking the second magnetic layers 42*e* and insulating layers 53*e* in the lateral direction W of the element body. The second multilayer part 32*e* and the third multilayer part 33*e* are arranged on the surfaces of the outermost layers of the first multilayer part 31*e* on both sides in the stacking direction with insulating layers 54*e* and 55*e* interposed therebetween. In addition, the second multilayer part 32*e* is divided by the gap part 44*e* that is perpendicular to the winding axis direction Z and the third multilayer part 33*e* is divided by the gap part 45*e* that is perpendicular to the winding axis direction Z. The gap parts 44*e* and 45*e* extend up to outer peripheral parts of the second multilayer part 32*e* and the third multilayer part 33*e* and are exposed from the side surfaces of the second multilayer part 32*e* and the third multilayer part 33*e* and from the surfaces of the outermost layers of the second multilayer part 32*e* and the third multilayer part 33*e* on both sides in the stacking direction. The gap parts 44*e* and 45*e* are formed of a material that adheres the respective divided parts of the second multilayer part 32*e* and the third multilayer part 33*e* together. In addition, the gap parts 44*e* and 45*e* are formed of a material having a lower relative magnetic permeability than the second magnetic layers 42*e*. In addition, the relative magnetic permeability of the gap parts 44*e* and 45*e* may be lower than the relative magnetic permeability of the element body, and the gap parts 44*e* and 45*e* may be formed of a non-magnetic material.

In the second multilayer part 32*e* and the third multilayer part 33*e*, the gap parts 44*e* and 45*e* are perpendicular to the winding axis direction Z and function as magnetic gaps, and have a high magnetic resistance in the winding axis direction. As a result, eddy current loss is further reduced.

In the inductor 100, the conductor forming the coil is a flat wire, but the conductor may instead be a conductor having a substantially circular or polygonal cross section.

In the inductor 100, the outer shape of the wound part of the coil as seen in the winding axis direction is a substantially elliptical or oval shape, but may instead be a substantially circular, rectangular, or polygonal shape, for example. The wound part of the coil is formed by winding the wire in two stages in a spiral shape, that is, the wound part of the coil is formed in an a winding shape (for example, refer to Japanese Unexamined Patent Application Publication No. 2009-239076), but may instead be formed as an edge wise winding or a plating conductor pattern.

In the inductor 100, the pair of extending parts respectively extend toward the end surfaces of the element body in the longitudinal direction, but may instead respectively extend toward side surfaces of the element body in the lateral direction.

In the inductor 100, the height of the core and the height of the wound part are formed so as to be substantially the same, but the height of the core may instead be larger or smaller than the height of the wound part.

In the inductor 100, the thickness of the first magnetic layers and the thickness of the second magnetic layers may be different from each other.

In the core 30*e* of eighth embodiment, the gap parts are provided in the second multilayer part and the third multilayer part, but alternatively a gap part may be provided in the first multilayer part or a gap part may be provided in only one out of the second multilayer part and the third multilayer part.

In the inductor of sixth embodiment or seventh embodiment, a gap part may be provided similarly to as in the core 30*e* of eighth embodiment in at least one out of the first multilayer part, the second multilayer part, and the third multilayer part.

In the inductors of first embodiment to eighth embodiment, the core has a substantially rectangular parallelepiped shape, but at least one edge of the core may be removed to form a flat surface or a curved surface.

The second multilayer part, the first multilayer part, and the third multilayer part are stacked in this order in the core, but alternatively only one out of the second multilayer part and the third multilayer part may be provided.

While preferred embodiments of the disclosure have been described above, it is to be understood that variations and modifications will be apparent to those skilled in the art without departing from the scope and spirit of the disclosure. The scope of the disclosure, therefore, is to be determined solely by the following claims.

What is claimed is:

1. An inductor comprising:

a core that includes a multilayer part in which magnetic layers and insulating layers are stacked in an alternating manner;

a coil that includes a wound part that is wound around a periphery of the core and a pair of extending parts that extend from the wound part, and in which a winding axis of the wound part is arranged along a winding axis direction so as to be substantially perpendicular to a stacking direction of the multilayer part; and an element body that has end surfaces that face each other and contains the core and the coil;

wherein the magnetic layers include first magnetic layers and second magnetic layers that have a larger electrical resistivity than the first magnetic layers, the multilayer part includes a first multilayer part in which the first magnetic layers and insulating layers are stacked in an alternating manner and a second multilayer part and a third multilayer part in which the second magnetic layers and insulating layers are stacked in an alternating manner, the first multilayer part has a first surface and a second surface that are perpendicular to the stacking direction and face each other and a third surface and a fourth surface that are surfaces that are parallel to the stacking direction and the winding axis direction and face each other, and the second multilayer part is arranged on the first surface and the third multilayer part is arranged on the second surface, or the second multilayer part is arranged on the third surface and the third multilayer part is arranged on the fourth surface.

2. An inductor comprising:

a core that includes a multilayer part in which magnetic layers and insulating layers are stacked in an alternating manner;

a coil that includes a wound part that is wound around a periphery of the core and a pair of extending parts that extend from the wound part, and in which a winding axis of the wound part is arranged along a winding axis direction so as to be substantially perpendicular to a stacking direction of the multilayer part; and an element body that has end surfaces that face each other and contains the core and the coil;

wherein the magnetic layers include first magnetic layers and second magnetic layers that have a larger relative magnetic permeability than the first magnetic layers, the multilayer part includes a first multilayer part in which the first magnetic layers and insulating layers are stacked in an alternating manner and a second multilayer part and a third multilayer part in which the second magnetic layers and insulating layers are stacked in an alternating manner, the first multilayer part has a first surface and a second surface that are perpendicular to the stacking direction and face each other and a third surface and a fourth surface that are surfaces that are parallel to the stacking direction and the winding axis direction and face each other, and the second multilayer part is arranged on the first surface and the third multilayer part is arranged on the second surface, or the second multilayer part is arranged on the third surface and the third multilayer part is arranged on the fourth surface.

3. The inductor according to claim 1, wherein a product of an electrical resistivity and a relative magnetic permeability of the second magnetic layers is larger than a product of an electrical resistivity and a relative magnetic permeability of the first magnetic layers.

4. The inductor according to claim 1, wherein the pair of extending parts respectively extend toward the facing end surfaces of the element body from an outer periphery of the wound part, and a number of second magnetic layers stacked in the second multilayer part and a number of second magnetic layers stacked in the third multilayer part are different from each other.

5. The inductor according to claim 1, wherein the stacking directions of at least two out of the first multilayer part, the second multilayer part, and the third multilayer part are different from each other.

6. The inductor according to claim 1, wherein at least one out of the first multilayer part, the second multilayer part, and the third multilayer part is divided along at least one plane that is substantially perpendicular to the winding axis direction of the wound part.

7. The inductor according to claim 1, wherein a numerical value obtained by dividing the square of the thickness of the second magnetic layer of the core by the square root of the product of the relative magnetic permeability and electrical resistivity of the second magnetic layer is smaller than a numerical value obtained by dividing the square of the thickness of the first magnetic layer of the core by the square root of the product of the relative magnetic permeability and electrical resistivity of the first magnetic layer.

8. The inductor according to claim 2, wherein a product of an electrical resistivity and a relative magnetic permeability of the second magnetic layers is larger than a product of an electrical resistivity and a relative magnetic permeability of the first magnetic layers.

9. The inductor according to claim 2, wherein the pair of extending parts respectively extend toward the facing end surfaces of the element body from an outer periphery of the wound part, and a number of second magnetic layers stacked in the second multilayer part and a number of second magnetic layers stacked in the third multilayer part are different from each other.

10. The inductor according to claim 3, wherein the pair of extending parts respectively extend toward the facing end surfaces of the element body from an outer periphery of the wound part, and a number of second magnetic layers stacked in the second multilayer part and a number of second magnetic layers stacked in the third multilayer part are different from each other.

11. The inductor according to claim 2, wherein the stacking directions of at least two out of the first multilayer part, the second multilayer part, and the third multilayer part are different from each other.

12. The inductor according to claim 3, wherein the stacking directions of at least two out of the first multilayer part, the second multilayer part, and the third multilayer part are different from each other.

13. The inductor according to claim 4, wherein the stacking directions of at least two out of the first multilayer part, the second multilayer part, and the third multilayer part are different from each other.

14. The inductor according to claim 2, wherein at least one out of the first multilayer part, the second multilayer part, and the third multilayer part is divided along at least one plane that is substantially perpendicular to the winding axis direction of the wound part.

15. The inductor according to claim 3, wherein at least one out of the first multilayer part, the second multilayer part, and the third multilayer part is divided along at least one plane that is substantially perpendicular to the winding axis direction of the wound part.

16. The inductor according to claim 4, wherein at least one out of the first multilayer part, the second multilayer part, and the third multilayer part is divided along at least one plane that is substantially perpendicular to the winding axis direction of the wound part.

17. The inductor according to claim 5, wherein at least one out of the first multilayer part, the second multilayer part, and the third multilayer part is divided along at least one plane that is substantially perpendicular to the winding axis direction of the wound part.

18. The inductor according to claim 2, wherein a numerical value obtained by dividing the square of the thickness of the second magnetic layer of the core by the square root of the product of the relative magnetic permeability and electrical resistivity of the second magnetic layer is smaller than a numerical value obtained by dividing the square of the thickness of the first magnetic layer of the core by the square root of the product of the relative magnetic permeability and electrical resistivity of the first magnetic layer.

19. The inductor according to claim 3, wherein a numerical value obtained by dividing the square of the thickness of the second magnetic layer of the core by the square root of the product of the relative magnetic permeability and electrical resistivity of the second magnetic layer is smaller than a numerical value obtained by dividing the square of the thickness of the first magnetic layer of the core by the square root of the product of the relative magnetic permeability and electrical resistivity of the first magnetic layer.

20. The inductor according to claim 4, wherein a numerical value obtained by dividing the square of the thickness of the second magnetic layer of the core by the square root of the product of the relative magnetic permeability and electrical resistivity of the second magnetic layer is smaller than a numerical value obtained by dividing the square of the thickness of the first magnetic layer of the core by the square root of the product of the relative magnetic permeability and electrical resistivity of the first magnetic layer.

* * * * *